US011445316B2

(12) United States Patent
Peeters

(10) Patent No.: US 11,445,316 B2
(45) Date of Patent: Sep. 13, 2022

(54) MANIPULATING SIGNAL FLOWS VIA A CONTROLLER

(71) Applicant: MUSICAL ARTWORKZ BVBA, Mol (BE)

(72) Inventor: Tim Peeters, Mol (BE)

(73) Assignee: MUSICAL ARTWORKZ BVBA, Mol (BE)

( * ) Notice: Subject to any disclaimer, the term of this patent is extended or adjusted under 35 U.S.C. 154(b) by 94 days.

(21) Appl. No.: 16/973,476

(22) PCT Filed: Jun. 13, 2019

(86) PCT No.: PCT/IB2019/054950
§ 371 (c)(1),
(2) Date: Dec. 9, 2020

(87) PCT Pub. No.: WO2020/003042
PCT Pub. Date: Jan. 2, 2020

(65) Prior Publication Data

US 2021/0250718 A1 Aug. 12, 2021

(30) Foreign Application Priority Data

Jun. 29, 2018 (BE) ..... 2018/5454

(51) Int. Cl.
*H04S 3/00* (2006.01)
*H04R 5/02* (2006.01)
*H04R 5/04* (2006.01)

(52) U.S. Cl.
CPC ..... *H04S 3/008* (2013.01); *H04R 5/02* (2013.01); *H04R 5/04* (2013.01); *H04S 2400/01* (2013.01);
(Continued)

(58) Field of Classification Search
None
See application file for complete search history.

(56) References Cited

U.S. PATENT DOCUMENTS 6,449,371 B1 * 9/2002 Tan ..... H04S 3/02 381/119
2014/0270263 A1 * 9/2014 Fejzo ..... H04S 3/00 381/119

FOREIGN PATENT DOCUMENTS

EP 2530956 A1 12/2012

OTHER PUBLICATIONS

International Search Report and Written Opinion for the International Patent Application No. PCT/IB2019/054950, dated Jul. 31, 2019, 10 pages.

* cited by examiner

*Primary Examiner* — Duc Nguyen
*Assistant Examiner* — Assad Mohammed
(74) *Attorney, Agent, or Firm* — KDB Firm PLLC

(57) ABSTRACT

A method for live manipulation of signal flows via a controller. The method includes feeding in a first signal flow and a further signal flow, each having X signal flow layers, where X is greater than 2. The method further includes separating the signal flow layers from each signal flow into a respective series of sub-signal flows, related to the signal flow, as according to a predetermined ratio, where each sub-signal flow has Y sub-signal flow layers, and where Y is smaller than X. The method includes reading a desired ratio between the first signal flow and the further signal flow via a controller. The method includes merging corresponding sub-signal flows as according to the desired ratio in order to obtain a modified series of sub-signal flows. The method includes feeding out the modified series.

8 Claims, 3 Drawing Sheets

(52) U.S. Cl.
CPC ..... *H04S 2400/05* (2013.01); *H04S 2400/07* (2013.01); *H04S 2400/13* (2013.01); *H04S 2420/07* (2013.01)

MANIPULATING SIGNAL FLOWS VIA A CONTROLLER

This is a national stage application filed under 35 U.S.C. § 371 of pending international application PCT/IB2019/054950, filed Jun. 13, 2019, which claims priority to Belgian Patent Application No. 20185454, filed Jun. 29, 2018, the entirety of which applications are hereby incorporated by reference herein.

FIELD

The invention relates to the manipulation of signal flows via a controller, more specifically for the purpose of obtaining a better audio experience for an audience.

BACKGROUND

As far as is known, all cultures in all ages have known music. Music has the quality of being able to evoke feelings and emotion. Music is used in different places and in different contexts, and typically serves there to improve an experience.

The most commonly used audio format is stereo. It is known that stereo music consists of a two-track audio signal: a left and a right signal. These are transmitted separately from the playback device to the respective left and right loudspeaker. In the context of concerts, dance parties, festivals, etc. musicians and/or artists and/or DJs manipulate stereo audio signals in order to thus influence the experience of the audience.

In the context of the film industry the use of 5.1 (or other) "surround sound" is established, wherein use is made of six (or a different number of) channels, more specifically left, right, rear left, rear right, center, Low-Frequency Effects (LFE). This provides a greater spatiality for approaching the listener from different directions. The greater spatiality enhances the experience.

An object of the invention is to provide a method and a device for manipulating signal flows for the purpose of obtaining an increased entertainment value when playing audio.

SUMMARY OF THE INVENTION

The invention provides for this purpose a method for live manipulation of signal flows via a controller, wherein the method comprises of: feeding in a first signal flow and a further signal flow, each having X signal flow layers, wherein X is greater than 2; separating the signal flow layers from each signal flow into a respective series of sub-signal flows, related to the signal flow, as according to a predetermined ratio, wherein each sub-signal flow has Y sub-signal flow layers, wherein Y is smaller than X; reading a desired ratio between the first signal flow and the further signal flow via a controller; merging corresponding sub-signal flows as according to the desired ratio in order to obtain a modified series of sub-signal flows; feeding out the modified series.

Within the context of the invention, manipulation is defined as mixing flows. Manipulation optionally further comprises at least one of adjusting tempo and/or pitch of the flows, inserting additional sound fragments and adding effects to the flows. It will be apparent to the skilled person that effects are adaptations of the flow, such as: flanger, gain, delay, reverb, phaser and so on.

Manipulating live audio files has been found to heighten audience experience. In practice DJs are limited to manipulating stereo files due to current audio equipment limitations. This audio equipment typically supports a processing to a maximum of two simultaneous audio tracks. Because of the limitation of the current software-hardware, it is impossible for a DJ to play and manipulate live surround audio with the current techniques. This is because a surround audio file consists of more than two audio tracks. The method according to the invention allows surround audio to be played and manipulated with existing software and hardware. Because a DJ is able to play and adapt surround sound in a live environment, a better audio experience is obtained for an audience.

Feeding in a first signal flow and a further signal flow, each having X signal flow layers, forms the starting point of the method. The current software-hardware limitations allow only a number Y of sub-signal flow layers to be processed. The invention is based on the insight that, by separating the X signal flow layers, flows with Y sub-signal flow layers are obtained, which can be processed further. This allows X signal flow layers to be processed with existing hardware and software, particularly when the number X of signal flow layers is greater than Y sub-signal flow layers. It will be apparent that the method allows the principle to remain applicable when the software-hardware capacity expands in the future, whereby Y increases.

Music has dimensions, traditionally, a commonly used technique is playing in mono. The term is used to indicate that all sounds are lead and reproduced via one single channel. Mono sound is music's first dimension. In contrast to mono, humans naturally hear in stereo. Humans have two ears, enabling them to receive two different signals, i.e. left and right. Stereo is the second dimension 2D of music. Providing a signal flow with more than 2 signal flow layers makes it possible to approach the audience from multiple directions. A signal flow with more than 2 signal flow layers can however not be manipulated with stereo equipment. By providing the signal flow with more than 2 signal flow layers the method provides the option of playing surround sound files. This elevates the 2D experience to a multi-dimensional height. It will be apparent that this is not limited to 5.1 or 7.1 formats, but can in principle be expanded further. In the hypothetical case that the software and hardware will for instance support the 5.1 format in the future, the invention will still be applicable for playing and manipulating music with more dimensions.

The separating of the X signal flow layers from each signal flow into a respective series of sub-signal flows with Y sub-signal flow layers, related to the signal flow, as according to a predetermined ratio makes it possible to process the audio with X signal flow layers in software and hardware. The sub-signal flows each have a number Y of sub-signal flow layers. It will be apparent here that Y is chosen subject to the hardware and/or software limitations. These sub-signal flow layers can then be manipulated on the basis of input via a controller.

A desired ratio between the first signal flow and the further signal flow can be read via the controller. This allows a DJ to influence the manipulation of two or more signals flows.

The corresponding sub-signal flows are merged as according to the desired ratio in order to obtain a modified series of sub-signal flows. This is possible because the processing unit is working with Y sub-signal flow layers which can be processed by the hardware and software. In this way it is possible to influence the series of sub-signal flows. Application of the method according to the invention enables live manipulation in combination with a multi-dimensional aspect so as to thus be able to provide additional entertainment value to the audience during the live performance.

The signal flows are preferably audio flows and the signal flow layers are preferably audio channels which are provided to be transmitted to different loudspeakers in a space in order to obtain surround audio. The invention serves the particular purpose of playing so-called true surround. This is advantageous because it improves the perception of sound spatialization by making use of sound localization: a listener's ability to identify the location or origin of a detected sound in direction and/or distance. The method thus allows different audio files to be played from different loudspeakers.

The signal flows are preferably mastered audio flows. It is generally accepted that music is produced by first capturing sounds of instruments or human voice during a recording session. The recording will then be edited and/or mixed, whereby the recording is processed, adapted and/or combined into an audio mix. In a final stage, called mastering, the ratio between all frequencies will be listened to and/or made visible, and sound corrections can be made using diverse auxiliary means. Mastering is defined as finalizing an audio mix into a uniform overall sound. By making use of mastered audio flows the method provides an improved sound of the audio flow. Each audio flow has already been unified in respect of tone, balance and dynamics by the mastering. The audio is mastered to convey a better experience to the audience.

Before the step of merging, the sub-signal flows are preferably synchronized in a processing unit. As an alternative to manual synchronization, synchronizing of the sub-signal flows in a processing unit has the advantage that the plurality of sub-signal flows are automatically brought to a predetermined tempo without active intervention. This will improve the transition and phrasing of the performance without there being any abrupt or interrupted moments.

A synchronization flow preferably runs in the processing unit, and the step of synchronizing is performed by synchronizing each sub-signal flow with the synchronization flow. The use of a synchronization flow provides for an adaptation in the processing unit which can be performed in technically simple manner by quantizing and shifting or mutually connecting different sub-signal flows in simple manner.

The controller preferably has volume controls which are operatively coupled to respective sub-signal flows from the series, and wherein the step of feeding out further comprises of feeding out at a volume which is related to a setting of the corresponding volume control. This enables an independent volume control of the respective sub-signal flows.

A volume pattern which extends over a predetermined period of time and is repetitively replicated is preferably defined, wherein the volume pattern for each signal flow layer from the modified series is provided with a different starting point, wherein the controller further has a pattern controller which is operatively coupled to the sub-signal flows, and wherein the step of feeding out further comprises of feeding out at a volume which is further related to a product of a setting of the pattern controller and the corresponding volume pattern. Because a volume pattern is provided for each sub-signal flow layer, the volume of the respective loudspeaker will follow the corresponding volume pattern when the modified series is fed out. When each sub-signal pattern is provided with a volume pattern starting at a different point, each respective loudspeaker will in turn follow this volume pattern and the loudspeakers will subsequently emit louder and quieter sound. The combination with different loudspeakers causes the sound to move though the space from loudspeaker to loudspeaker in a listener's perception.

The invention further provides a device comprising a processing unit configured for live manipulation of signal flows and comprising a controller configured to read a desired ratio between a first signal flow and at least one further signal flow, the controller being operatively connected to the processing unit.

The processing unit has a first infeed configured for feeding in the first signal flow and has at least one further infeed for feeding in the at least one further signal flow, wherein each signal flow has X signal flow layers, wherein X is greater than 2. The processing unit further has a separator configured to separate the signal flow layers from each signal flow into a respective series of sub-signal flows, related to the signal flow, as according to a predetermined ratio, wherein each sub-signal flow has Y sub-signal flow layers, wherein Y is smaller than X. The processing unit further has a mixer configured to merge corresponding sub-signal flows as according to the desired ratio in order to obtain a modified series of sub-signal flows. The processing unit further has an outfeed configured for feeding out the modified series.

The advantages and features relating to the method for live manipulation of signal flows via a controller also apply to the device according to the invention.

The invention will be further described with reference to an exemplary embodiment shown in the drawing.

In the drawing.

The same or similar elements are designated in the drawing with the same reference numerals.

In the context of the description mastering is defined as finalizing an audio mix into a uniform overall sound.

In the context of the description dimension is further defined in accordance with the number of layers of a signal flow. Each signal flow has a determined number of layers. For audio it is known to transmit different layers to different locations in a space. It will be apparent to the skilled person that mono sound has one dimension, also written as 1D, that stereo, which has two layers, has two dimensions 2D and that 5.1 surround audio has 6 dimensions 6D.

In the context of the description a controller is further defined as a device which transmits a signal on the basis of a physical input. It will be apparent to the skilled person that a controller can be any one of a computer mouse, touchpad, keyboard, Musical Instrument Digital Interface MIDI device, etc. It will be apparent to the skilled person here that the controller is not limited to the above described examples.

Figure 1:
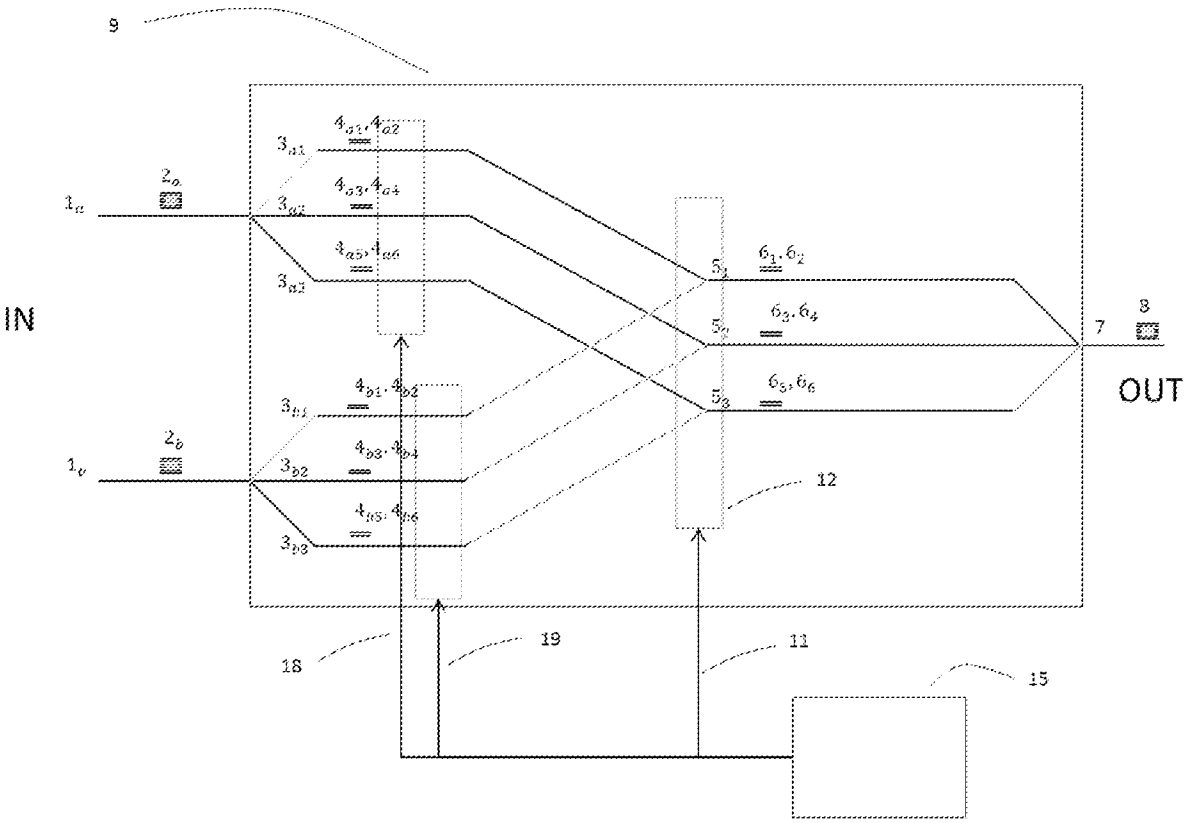
FIG. 1 shows a general flow of the method.

FIG. 1 shows a general flow of the method for live manipulation of signal flows 1*a*, 1*b*, . . . via a controller 15. Signal flows 1*a*, 1*b*, . . . are typically fed into a processing unit 9. The signal flows 1*a*, 1*b*, . . . in FIG. 1 are surround audio flows, more specifically a 5.1 surround form. Signal flows 1*a*, 1*b*, . . . each have 6 signal flow layers 2*a*, 2*b*, In the case of 5.1 surround audio these channels are typically used for left, right, center, rear left, rear right and LFE signals. It will be apparent to the skilled person that the method also provides for live manipulation of more than two signal flows 1*a*, 1*b*, 1*c*, 1*d*, etc.

FIG. 1 further shows that signal flows 1*a*, 1*b*, . . . are separated into sub-signal flows $\mathbf{3}a_1$, $\mathbf{3}a_2$, $\mathbf{3}a_3$ and $\mathbf{3}b_1$, $\mathbf{3}b_2$, $\mathbf{3}b_3$, as according to a predetermined ratio. In the context of separating signal flows into sub-signal flows it is also possible to refer to separating as according to a predetermined division. The sub-signal flows each have two sub-signal flow layers. In this embodiment signal flow 1*a*, 1*b* is separated as according to the 5.1 format into three sub-signal flows $3a_1$, $3a_2$, $3a_3$ and $3b_1$, $3b_2$, $3b_3$—left, right—LFE, center—rear left, rear right. Sub-signal flow left-right then represents $3a_1$; LFE-center represents $3a_2$ and rear left, rear right represents $3a_3$. Each sub-signal flow $3a_1$, $3a_2$, $3a_3$ and $3b_1$, $3b_2$, $3b_3$ has two sub-signal flow layers $4a_1$, $4a_2$, $4a_3$, $4a_4$, $4a_5$ and $4a_6$ and can further be processed as a stereo signal. Sub-signal flow $3a_1$ then has sub-signal flow layers $4a_1$, $4a_2$ as related layers. In this embodiment this would correspond with respectively the left and right sound signal. Sub-signal flow $3a_2$ has sub-signal flow layers $4a_3$, $4a_4$ as related layers and sub-signal flow $3a_3$ then has sub-signal flow layers $4a_5$, $4a_6$ as related layers. In the embodiment it has been chosen to separate into a series of sub-signal flows with two sub-signal flow layers because this embodiment assumes that hardware and/or software is able to process stereo audio files, in other words, to process two layers.

FIG. 1 further shows that, after separating of signal flows 1*a*, 1*b*, . . . into sub-signal flows $3a_1$, $3a_2$, $3a_3$ and $3b_1$, $3b_2$, $3b_3$, the sub-signal flows $3a_1$, $3a_2$, $3a_3$ (corresponding to signal flow 1*a*) are simultaneously triggered 18, as well as sub-signal flows $3b_1$, $3b_2$, $3b_3$ (corresponding to signal flow 1*b*) being simultaneously triggered 19. Each series of sub-signal flows will be processed further as a bundle, such that during processing the series of sub-signal flows remains coupled to each other in time.

FIG. 1 further shows that the different sub-signal flows $3a_1$, $3a_2$, $3a_3$ and $3b_1$, $3b_2$, $3b_3$ are merged 12 into a modified series of sub-signal flows $5_1$, $5_2$, $5_3$ as according to a desired ratio 11 by controller 15. $3a_1$ is merged with $3b_1$ into sub-signal flow $5_1$, $3a_2$ with $3b_2$ into $5_2$, etc. $3a_3$ is merged with $3b_3$ into sub-signal flow $5_3$. The modified sub-signal flows $5_1$, $5_2$, $5_3$ have related sub-signal flow layers $6_1$, $6_2$, $6_3$, $6_4$, $6_5$ and $6_6$.

The modified series of sub-signal flows $5_1$, $5_2$, $5_3$ are fed out by processing unit 9. After feeding out, the modified sub-signal flows can be played by loudspeakers.

In the illustrated embodiment of FIG. 1 the modified series of sub-signal flows $5_1$, $5_2$, $5_3$ are fed out. It will be apparent to the skilled person that the modified series of sub-signal flows $5_1$, $5_2$, $5_3$ can also be merged into a surround audio file 7 in processing unit 9. Surround audio file 7 then comprises the modified sub-signal flow layers $8_1$, $8_2$, $8_3$, $8_4$, $8_5$ and $8_6$.

Figure 2:
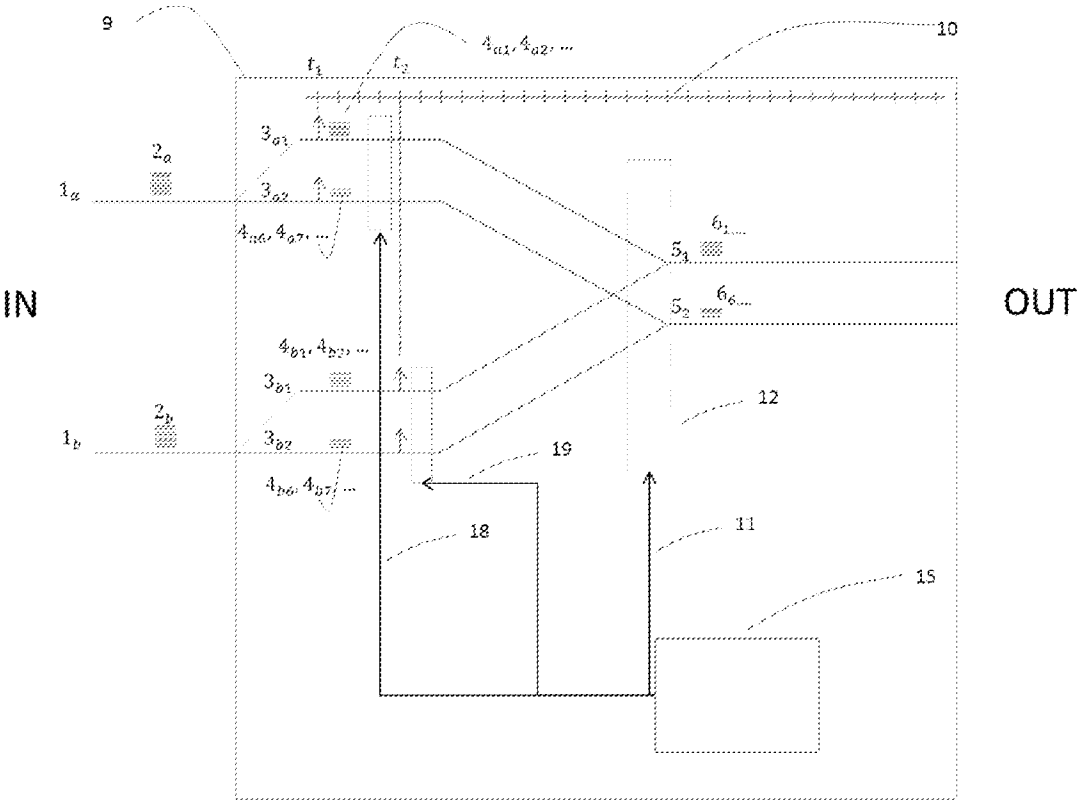
FIGS. 2 and 3 show alternative embodiments of a flow of the method.

FIG. 2 illustrates an alternative embodiment wherein the signal flows 1*a*, 1*b*, . . . have eight signal flow layers 2*a*, 2*b*, . . . which are fed into processing unit 9. The signal flows in FIG. 2 are separated into two sub-signal flows $3a_1$, $3a_2$. The alternative embodiment illustrates that the separating takes place as according to a determined ratio/division of the signal flow layers. The sub-signal flow $3a_1$ of FIG. 1 has 5 sub-signal flow layers $4a_1$-$4a_5$. The sub-signal flow $3a_2$ has three sub-signal flow layers $4a_6$-$4a_8$. In this embodiment it has been chosen to separate into a series of sub-signal flows with respectively five sub-signal flow layers and three sub-signal flow layers in order to demonstrate that the invention can also be applied in an alternative context. In this alternative context it is hypothetically assumed that hardware and/or software is able to process sub-signal flows with five flow layers. It will be apparent that this alternative context is a theoretical and purely hypothetical context of a more extensive hardware and/or software. This alternative embodiment serves only to illustrate the possibilities in future developments of hardware and/or software.

It will be apparent to the skilled person that in this alternative embodiment the series of sub-signal flows with the three signal flow layers can comprise two empty signal flows so that a total of five flow layers is obtained. The first and second sub-signal flows then each have five sub-signal flow layers and can then still be processed uniformly by the processing unit.

FIG. 2 further shows a synchronization flow 10 running in processing unit 9. Synchronizing of the sub-signal flows with a synchronization flow 10 has two aspects. A first aspect is to bring the flows to the same number of beats per minute, also referred to as BPM. The synchronization flow runs at a tempo determined by the user, which tempo determines the number of beats per minute BPM. In this embodiment it is assumed that this is 120 BPM. Each signal flow can be stretched or compressed so as to have the same beats per minute BPM. This principle is known to the skilled person and is therefore not further elucidated. Once the tempo of the synchronization flow is known, the processing unit will automatically bring sub-signal flows $3a_1$, $3a_2$, $3b_1$ and $3b_2$ to the predetermined tempo.

A second aspect relates to the aligning of the beats. This aspect is relevant once the sub-signal flows have been brought to the same tempo characteristic for the synchronization flow. More specifically, the sub-signal flows will be automatically aligned with the characteristic beat of the synchronization flow. After the aligning, sub-signal flows $3a_1$ and $3a_2$ will automatically begin to follow synchronization flow 10 at a point in time $t_1$. At a point in time $t_2$ the sub-signal flows $3b_1$ and $3b_2$ will then be synchronized with synchronization flow 10, before the step of merging 12.

The sub-signal flows $3a_1$, $3a_2$, $3b_1$ and $3b_2$ are brought to a predetermined tempo by the synchronizing. In other words, the sub-signal flows are brought to the same speed, also referred to as Beats per Minute (BPM). Owing to the synchronizing, more particularly the aligning, sub-signal flows $3a_1$, $3a_2$, $3b_1$ and $3b_2$ run concurrently in synchronized manner at point in time $t_2$, whereby the DJ can control the transition in simple manner by means of the controller. Once sub-signal flow $3a_1$, $3a_2$ is synchronized with synchronization flow 10, each sub-signal flow can be triggered 18 into playing the audio signal using controller 15. After synchronization of sub-signal flows $3b_1$ and $3b_2$, each of these sub-signal flows can also be simultaneously triggered 19 using controller 15.

FIG. 2 further shows that the different synchronized sub-signal flows $3a_1$, $3a_2$ and $3b_1$, $3b_{2,\ 3}$ are merged 12 as according to a desired ratio 11 by processing unit 9, on the basis of input from controller 15, into a modified series of sub-signal flows $5_1$, $5_2$. The desired ratio 11 relates here to a desired volume ratio between the signal flows. $3a_1$ is merged with $3b_1$ into sub-signal flow $5_1$, $3a_2$ with $3b_2$ into $5_2$. The modified sub-signal flows $5_1$, $5_2$ have related sub-signal flow layers $6_1$, $6_2$, $6_3$, $6_4$. Each modified sub-signal flow comprises the sub-signal flows in the desired volume ratio.

FIG. 2 further shows that the sub-signal flows can be fed out directly from processing unit 9.

Figure 3:
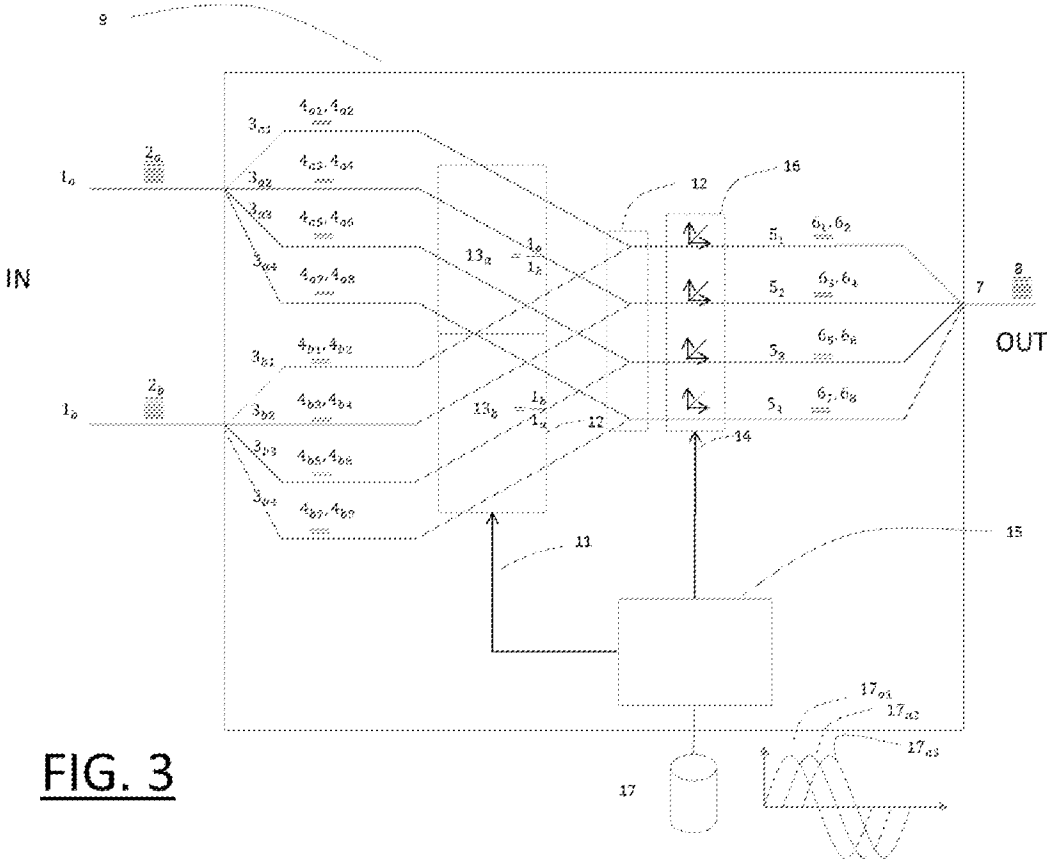

FIG. 3 shows a further alternative embodiment wherein signal flows 1*a*, 1*b*, . . . are fed into a processing unit 9. Signal flows 1*a*, 1*b*, . . . in FIG. 3 are 7.1 audio flows. Signal flows 1*a*, 1*b*, . . . each have 8 signal flow layers 2*a*, 2*b*, In 7.1 surround audio these channels are typically used for left, right, center, rear left, rear right and LFE and height-adjusted loudspeaker signals. Each sub-signal flow $3a_1$, $3a_2$, $3a_3$, $3a_4$ and $3b_1$, $3b_2$, $3b_3$, $3b_4$ has two sub-signal flow layers $4a_1$, $4a_2$, $4a_3$, $4a_4$, $4a_5$, $4a_6$, $4a_7$, $4a_8$. Sub-signal flow $3a_1$ then has sub-signal flow layers $4a_1$, $4a_2$ as related layers. In this embodiment this would correspond with respectively the left and right sound signal.

FIG. 3 further shows that a controller 15 reads 11 a desired ratio 13*a*, 13*b*. Ratio 13*a* is here the volume ratio between the first signal flow 1*a* and the further signal flow 1*b*, and ratio 13*b* is the reciprocal of 13*a*. After the desired ratio 13*a*, 13*b* has been read 11, the sub-signal flows can be merged 12 as according to the ratio 13*a*, 13*b*.

In an alternative embodiment FIG. 3 further shows that controller 15 has volume controls 16 which are operatively coupled to the respective sub-signal flows $5_1$, $5_2$, $5_3$, $5_4$. A DJ (disc jockey) or artist can control each individual output to the respective loudspeakers by means of the volume controls 16. A volume control can for instance be a rotary knob, slide or pressure-sensitive switch. The DJ can control the volume of the front left and right loudspeakers, or alternatively switch them off completely, by means of the volume control related to sub-signal flow $5_1$. It will be apparent that this can take place simultaneously or separately for each sub-signal flow. It will also be apparent to the skilled person that a DJ can control more than just the volume. A DJ can also control timbre related to each sub-signal flow by influencing the frequency bands. The frequency bands are typically separated into High (or Treble), Medium and Low (or Bass).

FIG. 3 further shows in an alternative embodiment that the controller can define a pattern 17 on each modified sub-signal flow layer. FIG. 2 shows particularly an embodiment wherein a volume pattern $17a_1$, $17a_2$, . . . is defined, which is repetitively replicated. In the alternative embodiment a sinusoidal volume pattern is illustrated. Volume pattern $17a_1$ is provided with a different starting point than volume pattern $17a_2$, $17a_3$, etc. It will be apparent that any pattern can be applied to the modified sub-signal flow layers. A pattern can for instance also be a timbre pattern. It is alternatively also possible for a pattern not to be repetitively replicated.

The signal flows can for instance have a Dolby Surround, Dolby Surround-Ex, Dolby Atmos, DTS, DTS-ES, Auro 3D, SDDS format. It is also possible to manipulate any other form of surround audio.

In the illustrated embodiment of FIG. 1 a 6-channel surround sound audio file is illustrated. It will be apparent to the skilled person, as illustrated in FIG. 3, that 7.1, 10.2, 11.1, 22.2 surround sound audio files, or variants thereof, can also be manipulated.

It will be apparent to the skilled person that the sub-signal flows can have any audio coding format. The sub-signal flows can for instance be converted into MP3, WAV, AAC, but are not limited thereto.

The skilled person will appreciate on the basis of the above description that the invention can be embodied in different ways and on the basis of different principles. The invention is not limited here to the above described embodiments. The above described embodiments and the figures are purely illustrative and serve only to increase understanding of the invention. The invention is not therefore limited to the embodiments described herein, but is defined in the claims.

The invention claimed is:

1. A method for live manipulation of signal flows via a controller, the method comprising:

feeding in a first signal flow and a further signal flow, each having X signal flow layers, wherein X is greater than 2;

separating the signal flow layers from each signal flow into a respective series of sub-signal flows, related to the signal flow, as according to a predetermined ratio, wherein each sub-signal flow has Y sub-signal flow layers, wherein Y is smaller than X;

reading a desired ratio between the first signal flow and the further signal flow via a controller;

merging corresponding sub-signal flows as according to the desired ratio in order to obtain a modified series of sub-signal flows; and feeding out the modified series.

2. The method according to claim 1, wherein the signal flows are audio flows and wherein the signal flow layers are audio channels provided to be transmitted to different loudspeakers in a space in order to obtain surround audio.

3. The method according to claim 2, wherein the signal flows are mastered audio flows.

4. The method according to claim 1, further comprising synchronizing the sub-signal flows in a processing unit before the step of merging.

5. The method according to claim 4, wherein a synchronization flow runs in the processing unit, and wherein the step of synchronizing is performed by synchronizing each sub-signal flow with the synchronization flow.

6. The method according to claim 1, wherein the controller has volume controls which are operatively coupled to respective sub-signal flows from the series, and wherein the step of feeding out further comprises feeding out at a volume related to a setting of the corresponding volume control.

7. The method according to claim 1, wherein a volume pattern is defined which extends over a predetermined period of time and is repetitively replicated, wherein the volume pattern for each sub-signal flow layer from the modified series is provided with a different starting point, wherein the controller further has a pattern controller which is operatively coupled to the sub-signal flows, and wherein the step of feeding out further comprises feeding out at a volume which is further related to a product of a setting of the pattern controller and the corresponding volume pattern.

8. A device comprising:

a processing unit configured for live manipulation of signal flows and a controller configured to read a desired ratio between a first signal flow and at least one further signal flow, the controller being operatively connected to the processing unit;

wherein the processing unit has a first infeed configured for feeding in the first signal flow and has at least one further infeed for feeding in the at least one further signal flow, wherein each signal flow has X signal flow layers, wherein X is greater than 2;

wherein the processing unit further has a separator configured to separate the signal flow layers from each signal flow into a respective series of sub-signal flows, related to the signal flow, as according to a predetermined ratio, wherein each sub-signal flow has Y sub-signal flow layers, wherein Y is smaller than X;

wherein the processing unit further has a mixer configured to merge corresponding sub-signal flows as according to the desired ratio in order to obtain a modified series of sub-signal flows; and wherein the processing unit further has an outfeed configured for feeding out the modified series.

* * * * *